US007658535B2

(12) United States Patent
Flechsig et al.

(10) Patent No.: US 7,658,535 B2
(45) Date of Patent: Feb. 9, 2010

(54) LAMP HAVING IMPROVED VIBRATION DAMPING

(75) Inventors: Jurgen Flechsig, Plauen (DE); Sven Reyer, Schoeneck (DE); Andreas Trampler, Plauen (DE); Peter Rosenmuller, Plauen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 440 days.

(21) Appl. No.: 11/573,001

(22) PCT Filed: Jul. 28, 2005

(86) PCT No.: PCT/IB2005/052544

§ 371 (c)(1),
(2), (4) Date: Jan. 31, 2007

(87) PCT Pub. No.: WO2006/016314

PCT Pub. Date: Feb. 16, 2006

(65) Prior Publication Data

US 2009/0027906 A1 Jan. 29, 2009

(30) Foreign Application Priority Data

Aug. 5, 2004 (EP) ..... 04103776

(51) Int. Cl.
*H01R 33/00* (2006.01)
*H01J 5/48* (2006.01)

(52) U.S. Cl. ..... 362/647; 362/549; 362/652; 362/655; 362/263; 362/509; 313/318.01; 313/318.07; 313/318.09; 313/318.1; 313/317

(58) Field of Classification Search ..... 362/647, 362/652, 655, 549, 263, 509; 313/318.01, 313/318.07, 318.09, 318.1
See application file for complete search history.

(56) References Cited

U.S. PATENT DOCUMENTS

| | | | | |
|---|---|---|---|---|
| 4,547,838 | A | 10/1985 | Wakimizu | |
| 5,041,955 | A | 8/1991 | Devir et al. | |
| 5,153,480 | A | 10/1992 | Schoenherr et al. | |
| 5,313,135 | A | 5/1994 | Fletcher | |
| 6,210,029 | B1 * | 4/2001 | Noll et al. | 362/549 |
| 6,215,236 | B1 | 4/2001 | Gotoh et al. | |
| 6,710,526 | B1 * | 3/2004 | Helbig | 362/640 |
| 7,275,855 | B2 * | 10/2007 | Protsch et al. | 362/652 |
| 7,326,072 | B2 * | 2/2008 | Lutsch et al. | 439/332 |

FOREIGN PATENT DOCUMENTS

| | | |
|---|---|---|
| DE | 19601396 A1 | 7/1997 |
| DE | 19601396 CE | 7/1997 |
| DE | 19700098 A1 | 7/1997 |

(Continued)

*Primary Examiner*—Stephen F Husar
*Assistant Examiner*—James W Cranson

(57) ABSTRACT

The invention relates to a lamp (8), in particular a vehicle lamp, having a base (17), a burner (7) having a light-generating element (11, 12), and an adapter plate (1) having a connecting region (2) and a receiving portion (3), the connecting region (2) being connected to the base (17) and the receiving portion (3) to the burner (7). The adapter plate (1) has cutouts (4) between the connecting region (2) and the receiving portion (3) such that the connection region (2) is no longer rigid but has a certain flexibility.

7 Claims, 3 Drawing Sheets

FOREIGN PATENT DOCUMENTS

| | | | |
|---|---|---|---|
| DE | 19700098 | B4 | 7/1997 |
| EP | 0193997 | A1 | 9/1986 |
| EP | 0193997 | B1 | 9/1986 |
| EP | 0618609 | A1 | 10/1994 |
| EP | 0618609 | B1 | 10/1994 |
| FR | 609223 | A | 8/1926 |
| FR | 916998 | A | 12/1946 |
| JP | 2002358935 | A | 12/2002 |

* cited by examiner

LAMP HAVING IMPROVED VIBRATION DAMPING

The invention relates to a lamp, in particular a vehicle lamp, having a base, a burner having a light-generating element, and an adapter plate having a connecting region and a receiving portion, the connecting region being connected to the base and the receiving portion being connected to the burner.

Known lamps of the kind specified in the opening paragraph have a burner in which the light-generating element proper, such as, for example, one or more incandescent filaments, is formed in a glass envelope. In lamps of this kind, the connection of the burner to a lamp base is made for example by using an adapter plate made of metal, which is connected on the one hand to the lamp base and on the other hand to the burner. To allow the burner to be connected to the lamp base electrically, the latter has conductor guides through which the supply wires projecting from the burner are run to corresponding terminals arranged in the terminal region of the lamp base that are used to make contact with the lamp.

Known from DE 196 01 396 is a cementless capped halogen incandescent lamp of the kind specified in the opening paragraph in which the burner is fixed by clamping in an opening in a holder part, the holder part itself being fastened to a sleeve forming part of a base of the lamp.

All lamps of the kind specified in the opening paragraph have the disadvantage that, when used in a vehicle, because of their rigid construction they transmit the vibrations that occur during the operation of the vehicle undamped to the burner, and in particular to the filaments arranged therein, as a result of which their working life is considerably shortened due to the fractures that regularly occur in the filaments. Low resonances in particular have an especially adverse effect on the life of the lamps in this case.

It is an object of the invention to provide a lamp of simple and strong construction that has a high capacity for withstanding vibrations and oscillations.

The invention achieves this object with a lamp as claimed in claim 1. Advantageous embodiments of the invention are specified in the dependent claims.

A characterizing feature of the lamp according to the invention is the design of the adapter plate, which has cutouts between the connecting region and the receiving portion. The cutouts, which create an open space between the receiving portion and the connecting region, are in this case of a form such that the connection between the receiving portion and the connecting region is no longer rigid but has a certain flexibility. Oscillations and vibrations that, where the lamp according to the invention is used in a vehicle, inevitably occur during the operation of the vehicle, are thus damped in such a way that the vibrations that are transmitted to the burner and that may damage the incandescent filaments are considerably reduced.

Consequently, the life of the lamps according to the invention is increased as compared with lamps of the same kind in which the vibrations are transmitted undamped to the internal structure of the lamp. The occurrence of filament fractures is, in particular, considerably reduced by the construction according to the invention of the lamp.

In principle, the form taken by the cutouts, and hence the form taken by the connection between the receiving portion and the connecting region, may be as desired, the position, size and shape of the cutouts having a considerable effect on the damping properties of the lamp. However, in an advantageous embodiment of the invention, the cutouts are of a design such that the connecting region and the receiving portion are connected together by bridges, and preferably by four bridges extending substantially perpendicularly to the axis of the burner.

The bridges may likewise be of any desired dimensions in this case and may be aligned as desired. The bridges are preferably arranged on the connecting region in opposing pairs. As an alternative however, what is also possible is an arrangement for the bridges where they are uniformly distributed around the circumference of the connecting region, the preferred arrangement of the bridges in opposing pairs on the one hand ensuring that the lamp has a particularly high damping action, while on the other hand, and at the same time, the connection between the connecting region and the receiving portion is of adequate strength, thus ensuring that the burner will be reliably positioned in a reflector of a headlight. This is an essential prerequisite for a consistently aligned beam from the headlight, something that is laid down as mandatory for vehicles.

A further advantage of this embodiment of the invention is that there is no need for a totally new design for the known adapter plate. Hence it is possible for an adapter plate according to the invention to be produced by a simple reworking and/or post-processing of conventional solid adapter plates. Alternatively, it is possible for the making of the cutouts, by punching for example, to be incorporated in the production process at some suitable point.

In an advantageous embodiment of the invention, a top face of the receiving portion is arranged to be offset from a plane that extends parallel to the top face and through a portion of the connecting region that adjoins the cutouts. In this embodiment of the invention, the receiving portion is displaced relative to the connecting region, the receiving portion preferably being arranged above the connecting region. Terms such as "above" and "below" that are used to describe the arrangement of the components relative to one another refer in this case to an upright position of the lamp in which the burner is arranged at the top. This statement of a reference orientation is intended solely to assist understanding and should not be construed as a limitation.

This embodiment of the invention, in which the region between the receiving portion and the connecting region may for example even be inclined to a perpendicular to the axis of the burner, makes it possible, in the case of a preferred arrangement of the receiving portion above the connecting region, for the angle of the emitted light to be increased in comparison with lamps in which the receiving portion and the connecting region are arranged in a plane.

What is more, this embodiment of the invention allows the damping properties to be fixed in such a way that the lamp has different damping properties to suit the orientation of the oscillations and vibrations.

In a particularly advantageous embodiment of the invention, the top face of the receiving portion is arranged to be parallel with but offset from a plane formed by the bridges. Hence the receiving portion and the bridges are connected together by a step that extends substantially at right angles to the top face and the bridges.

Because of the bridges that extend parallel to the receiving portion, this embodiment of the invention ensures especially good damping of all vibrations that act on the burner axially, which vibrations have a particularly adverse effect on the life of the filaments arranged in the burner. This embodiment of the invention also has the advantage that the angle of the emitted light can be increased towards the lamp base in a special way in comparison with an arrangement where the connecting region and the receiving portion are in a plane.

Basically, the way in which the burner is arranged on the receiving portion can be freely selected. It may for example be bonded into the receiving portion. However, in an advantageous embodiment of the invention the receiving portion has an opening in which the burner is fixed by clamping, thus enabling any additional physically united connection of the burner to the adapter plate to be dispensed with.

To ensure that the burner is fixed in the receiving portion particularly well and, at the same time, to prevent the burner from tilting when being inserted in the receiving portion at the time of assembly, in a further special embodiment of the invention the burner has two wide sides and two narrow sides in the region where contact is made with the receiving portion and the opening has supporting tabs directed towards the narrow sides. As well as ensuring that the burner is reliably positioned, this embodiment of the invention also increases the damping properties of the lamp, because the supporting tabs produce an additional damping effect.

These and other aspects of the invention are apparent from and will be elucidated with reference to the embodiments described hereinafter.

IN THE DRAWINGS

Figure 1:
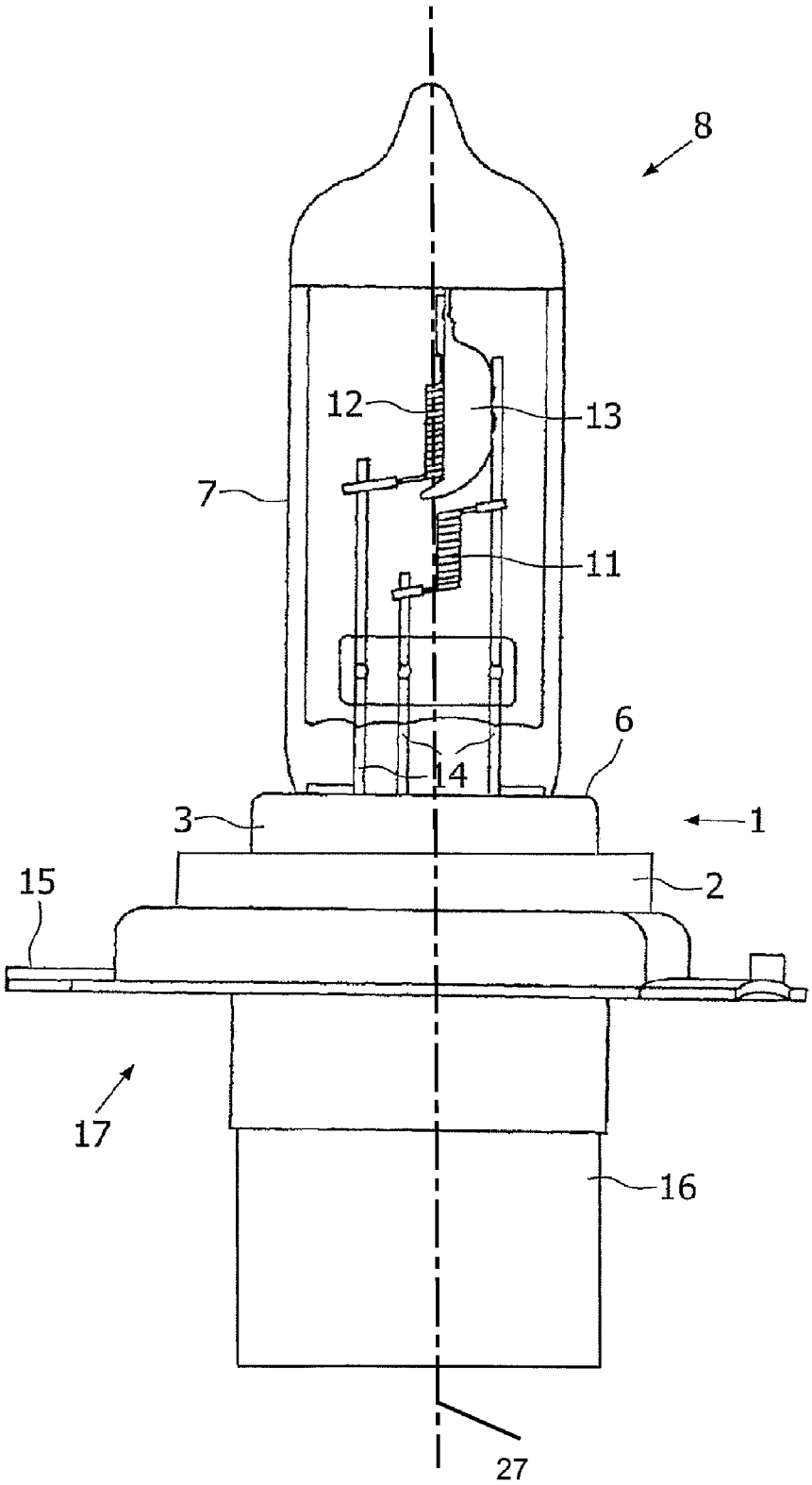
FIG. 1 is a side view of a lamp having a two-stepped adapter plate.

The embodiment of lamp 8 according to the invention that is shown in FIG. 1 is a lamp 8 for use in a motor vehicle headlight, which is not shown in the present case.

The lamp 8 has a burner 7 with a central axis 27 that is formed by a glass envelope in the interior of which are situated two incandescent filaments 11, 12. The incandescent filaments 11, 12 are supplied with current via fused-in supply wires 14 that are fastened to corresponding terminal members (not shown here) in the interior of the lamp base 17. One of the incandescent filaments 11 is provided with a dipped-beam base 13.

A locating flange 15 and a terminal region 16 together form the lamp base 17. The adapter plate 1 is welded to the locating flange 15, which is used to line up the lamp 8 in a headlight.

Figure 2:
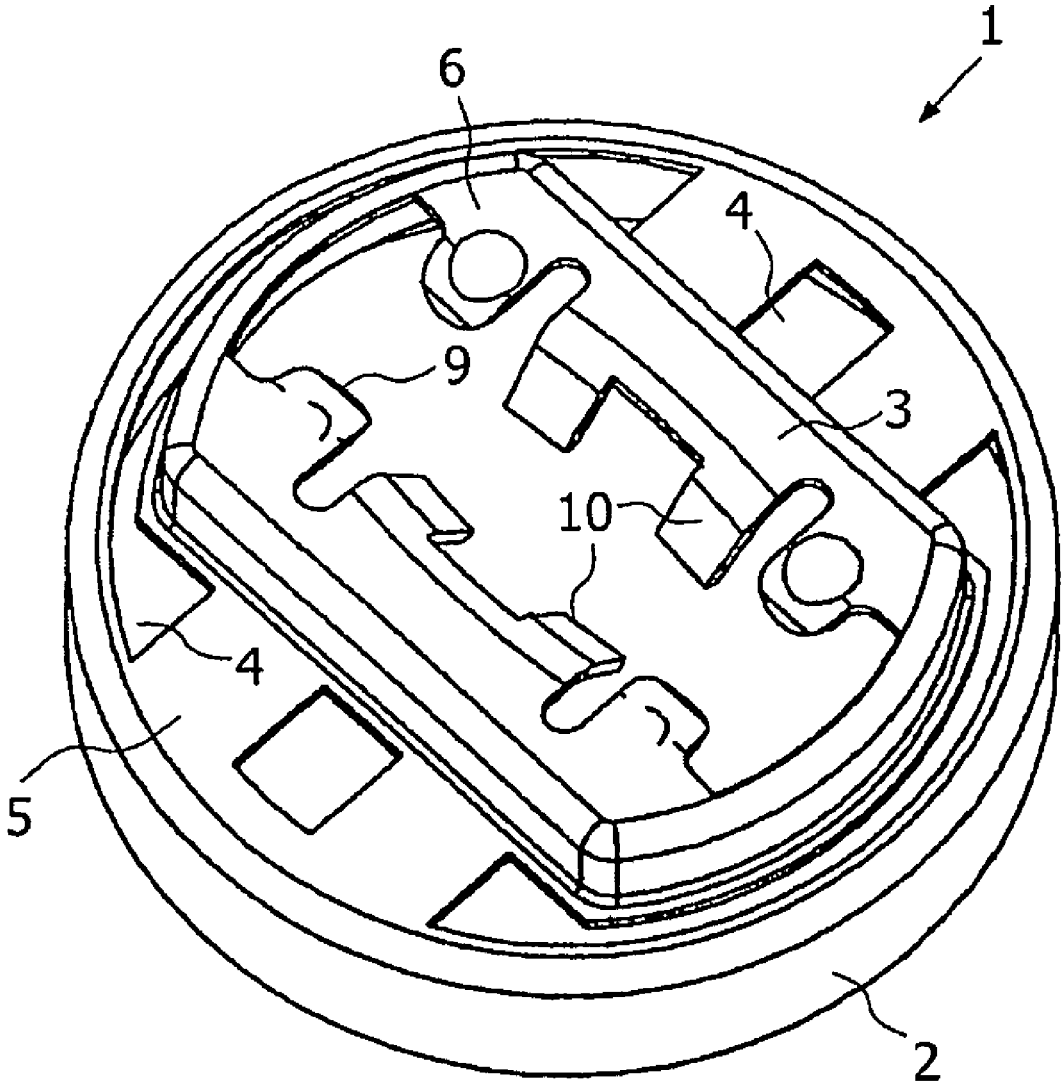
FIG. 2 is a perspective view of the adapter plate of the lamp of FIG. 1.
Figure 4:
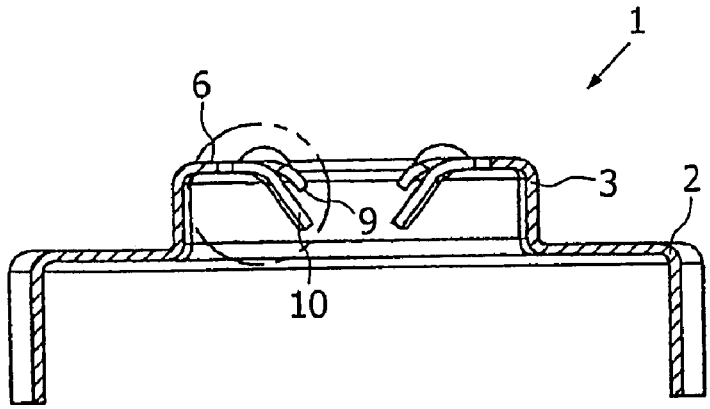
FIG. 4 is a section through the adapter plate of FIG. 2.

By its end adjacent to the lamp base 17, the burner 7 is fixed by clamping in an opening 9 in the receiving portion 3 of the adapter plate 1, in which case supporting tabs 10 that press against the wide side of the burner 7 fix the burner to the adapter plate in such a way that it is firmly connected to the adapter plate 1 (see FIG. 2 and FIG. 4).

Figure 3:
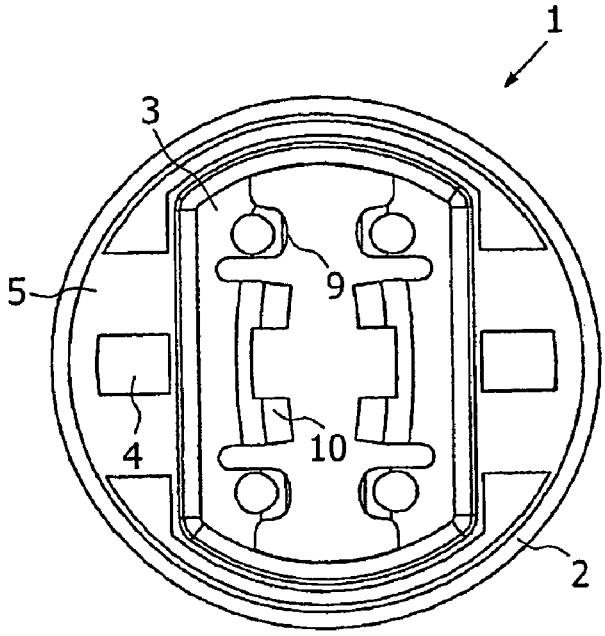
FIG. 3 is a plan view of the adapter plate of FIG. 2.

As can be seen from FIGS. 2 and 3, a region between the connecting region 2, which latter is connected to a ring that is circular in cross-section and of a cylindrical form, and the receiving portion 3, has cutouts 4, which means that the connecting region 3 and the receiving portion 2 are connected together by a total of four bridges 5.

The plane defined by the bridges 5 extends in this case parallel to a top face 6 of the receiving portion 3, which ensures that, when a motor vehicle is operating, vibrations, and particularly vibrations directed along the axis of the burner, are transmitted towards the internal structure of the burner 7 only in a damped form, which means that overall the lamp 8 has high resistance to vibrations.

The invention claimed is:

1. A lamp, comprising:

a base, a burner having a central axis and comprising a light-generating element, and an adapter plate comprising a connecting region and a receiving portion having a top face, the connecting region being connected to the base and the receiving portion being connected to the burner, the adapter plate defining one or more cutouts between the connecting region and the receiving portion, wherein the cutouts are configured such that the connecting region and the receiving portion are connected together by a plurality of bridges extending substantially perpendicularly to the central axis of the burner.

2. A lamp as claimed in claim 1, wherein the top face of the receiving portion is arranged to be offset from but parallel to a plane defined by the bridges.

3. A lamp as claimed in claim 1, wherein the receiving portion has an opening in which the burner is fixed by clamping.

4. A lamp as claimed in claim 1, wherein, in the region of contact with the receiving portion, the burner has two wide sides and two narrow sides and the opening has supporting tabs directed towards the wide sides.

5. A lamp, comprising:

a base, a burner having a central axis and comprising a light-generating element, and an adapter plate comprising a connecting region and a receiving portion having a top face, the connecting region being connected to the base and the receiving portion being connected to the burner, the adapter plate defining one or more cutouts between the connecting region and the receiving portion, wherein the top face of the receiving portion is arranged to be offset from a plane that extends parallel to the top face and through the portion of the connecting region that is adjacent to the cutouts.

6. A lamp as claimed in claim 5, wherein the top face of the receiving portion is arranged to be offset from but parallel to a plane defined by the bridges.

7. A lamp as claimed in claim 5, wherein the receiving portion has an opening in which the burner is fixed by clamping.

* * * * *